US010808371B2

(12) United States Patent
Hedberg

(10) Patent No.: US 10,808,371 B2
(45) Date of Patent: Oct. 20, 2020

(54) METHOD FOR CONSTRUCTING BUILDING ON WATER-BODY

(71) Applicant: Admares Group Oy, Turku (FI)

(72) Inventor: Mikael Hedberg, Turku (FI)

(73) Assignee: Admares Group Oy, Turku (FI)

( * ) Notice: Subject to any disclaimer, the term of this patent is extended or adjusted under 35 U.S.C. 154(b) by 0 days.

(21) Appl. No.: 16/433,546

(22) Filed: Jun. 6, 2019

(65) Prior Publication Data

US 2020/0095744 A1 Mar. 26, 2020

(30) Foreign Application Priority Data

Sep. 20, 2018 (FI) ..... 20185786

(51) Int. Cl.

| | |
|---|---|
| ***E02B 17/00*** | (2006.01) |
| ***E02D 9/00*** | (2006.01) |
| ***E02D 27/52*** | (2006.01) |
| ***E02D 7/00*** | (2006.01) |

(52) U.S. Cl.

CPC ..... *E02B 17/00* (2013.01); *E02D 7/00* (2013.01); *E02D 9/005* (2013.01); *E02D 27/525* (2013.01); *E02B 2017/0039* (2013.01); *E02B 2017/0043* (2013.01)

(58) Field of Classification Search

CPC ..... E02D 5/223; E02D 7/00; E02D 9/005; E02D 27/525; E02B 17/00; E02B 2017/0039; E02B 2017/0043

See application file for complete search history.

(56) References Cited

U.S. PATENT DOCUMENTS 3,878,662 A * 4/1975 Cernosek ..... E02B 17/00 52/745.18
5,531,544 A * 7/1996 Willcox, II ..... E02D 5/22 405/231

(Continued)

FOREIGN PATENT DOCUMENTS

CN 206941325 * 1/2018
CN 108532769 A 9/2018

(Continued)

OTHER PUBLICATIONS

Finnish Patent and Registration Office, Search Report, Application No. 20185786, dated Mar. 29, 2019, 2 pages.

(Continued)

*Primary Examiner* — Carib A Oquendo
(74) *Attorney, Agent, or Firm* — Ziegler IP Law Group, LLC

(57) ABSTRACT

A method for constructing a building on a water-body. The method includes piling a plurality of piles on a bed of the water-body for laying a foundation for the building. The method further includes marking a reference-mark on each of the plurality of piles at a predefined-distance from a surface of the water-body. The method also includes cutting each of the plurality of piles along the reference-mark. The method further comprises installing a first pile-cap, having a plurality of guiding elements extending therefrom, over a first set of piles of the plurality of piles. The method also comprises installing a second pile-cap over a second set of piles of the plurality of piles.

18 Claims, 8 Drawing Sheets

(56) References Cited

U.S. PATENT DOCUMENTS

| | | | | | |
|---|---|---|---|---|---|
| 5,746,544 | A * | 5/1998 | Baghoomian | E01C 3/006 | 404/43 |
| 7,410,327 | B2 * | 8/2008 | Baugh | E02D 27/35 | 405/204 |
| 8,734,058 | B1 * | 5/2014 | Schmidt | E02D 5/64 | 405/255 |
| 2012/0011665 | A1 * | 1/2012 | Porter | E04G 11/48 | 14/75 |
| 2014/0356076 | A1 * | 12/2014 | Hale | E02D 5/223 | 405/255 |
| 2016/0251819 | A1 * | 9/2016 | Dinh | E02D 33/00 | 73/784 |
| 2016/0376762 | A1 * | 12/2016 | Wong | E02B 17/0008 | 405/210 |

FOREIGN PATENT DOCUMENTS

| | | | | |
|---|---|---|---|---|
| CN | 207862744 | U | | 9/2018 |
| JP | 59076317 | | * | 5/1984 |
| KR | 20140018651 | A | | 2/2014 |
| KR | 1020140018651 | | * | 2/2014 |
| WO | WO 2014/193023 | | * | 12/2014 |

OTHER PUBLICATIONS

Muszynski et al. "Horizontal Displacement Control in Course of Lateral Loading of a Pile in a Slope" In: IOP Conf. Series: Materials Science and Enginjeering, IOP Publicshing, 2017, vol. 245, DOI: 0.1088/1757-899X/245/3/032002, 9 pages.

* cited by examiner

METHOD FOR CONSTRUCTING BUILDING ON WATER-BODY

TECHNICAL FIELD

The present disclosure relates generally to buildings or infrastructure; and more specifically, to methods for constructing a building on a water-body, and buildings constructed on a water-body.

BACKGROUND

The increase in population with time has certainly caused shortage of certain basic amenities, such as land for construction of buildings. However, in the same time with the advancement in technology, a bed of water-body can be used as an alternative to land for the construction of buildings. Therefore, nowadays certain buildings can be seen constructed over a water-body, such as on river, sea or ocean. Notably, the construction of buildings on the bed of water-body requires a foundation to be laid before the construction of buildings. Generally, a pile-foundation comprising piles and pile-caps can be employed as a foundation for the construction of buildings on the bed of water-body.

The pile-foundation requires the pile-caps to be positioned horizontally with respect to a surface of the water-body over the piles. The horizontal position of the pile-caps is necessary for an even load distribution of the building to be constructed over the pile-foundation. Typically, the even load distribution of the building enables stability and longevity of the building.

However, the construction of such buildings over the bed of water-body employing the pile-foundation is associated with several problems. One of the main problems associated with the pile-foundation is attainment of a horizontal surface by the pile-caps to provide the horizontal surface for the construction of buildings. Furthermore, the attainment of the horizontal surface by the pile-caps is largely affected by environmental factors such as tides occurring in the water-body, waves in the water-body and so forth. Moreover, workers employed for the laying of pile-foundation experience unstable working surface due to motion of water in the water-body, thereby affecting skills of the workers.

Therefore, in light of the foregoing discussion, there exists a need to overcome the aforementioned drawbacks associated with construction of a building on a water-body employing pile-foundation.

SUMMARY

The present disclosure seeks to provide a method for constructing a building on a water-body. The present disclosure also seeks to provide a building on a water-body. The present disclosure seeks to provide a solution to the existing problem of complex and a challenging task of attainment of a horizontal surface by pile-caps to provide a horizontal surface for construction of buildings. An aim of the present disclosure is to provide a solution that overcomes at least partially the problems encountered in prior art, and provide the method for constructing a building on a water-body.

In one aspect, an embodiment of the present disclosure provides a method for constructing a building on a water-body, the method comprising:

piling a plurality of piles on a bed of the water-body for laying a foundation for the building;

marking a reference-mark on each of the plurality of piles, wherein the reference-mark is at a predefined-distance from a surface of the water-body;

cutting each of the plurality of piles along the reference-mark;

installing a first pile-cap, having a plurality of guiding elements extending therefrom, over a first set of piles of the plurality of piles, wherein the installation of the first pile-cap comprises aligning the plurality of guiding elements to be received by the first set of piles, adjusting an inclination of the first pile-cap with respect to the first set of piles to allow the first pile-cap to be parallel with respect to surface of the water-body, and coupling the first pile-cap rigidly with the first set of piles; and installing a second pile-cap over a second set of piles of the plurality of piles, wherein the installation of the second pile-cap comprises placing the second pile-cap adjacent to and in contact with the first pile-cap, adjusting an inclination of the second pile-cap using the first pile-cap to allow the second pile-cap to be parallel with respect to the surface of the water-body, wherein the inclination of the second pile-cap using the first pile-cap is adjusted using at least one of: at least one weight and a set of winching tools, and coupling the second pile-cap rigidly with the first pile-cap and the second set of piles.

In another aspect, an embodiment of the present disclosure provides a building on a water-body, the building comprising:

a plurality of piles for laying a foundation for the building, wherein each of the plurality of piles is piled on a bed of the water-body, marked using a reference-mark at a predefined-distance from a surface of the water-body, and cut along the reference-mark;

a first pile-cap, having a plurality of guiding elements extending therefrom, installed over a first set of piles of the plurality of piles, wherein the first pile-cap is installed by aligning the plurality of guiding elements to be received by the first set of piles, adjusting an inclination of the first pile-cap with respect to the first set of piles to allow the first pile-cap to be parallel with respect to the surface of the water-body, and coupling the first pile-cap rigidly with the first set of piles; and a second pile-cap installed over a second set of piles of the plurality of piles, wherein the second pile-cap is installed by placing the second pile-cap adjacent to and in contact with the first pile-cap, adjusting an inclination of the second pile-cap using the first pile-cap to allow the second pile-cap to be parallel with respect to the surface of the water-body, wherein the inclination of the second pile-cap using the first pile-cap is adjusted using at least one of: at least one weight and a set of winching tools, and coupling the second pile-cap rigidly with the first pile-cap and the second set of piles.

Embodiments of the present disclosure substantially eliminate or at least partially address the aforementioned problems in the prior art, and enable attainment of the horizontal surface by the pile-caps to provide the horizontal surface for construction of buildings.

Additional aspects, advantages, features and objects of the present disclosure would be made apparent from the drawings and the detailed description of the illustrative embodiments construed in conjunction with the appended claims that follow.

It will be appreciated that features of the present disclosure are susceptible to being combined in various combinations without departing from the scope of the present disclosure as defined by the appended claims.

BRIEF DESCRIPTION OF THE DRAWINGS

The summary above, as well as the following detailed description of illustrative embodiments, is better understood when read in conjunction with the appended drawings. For the purpose of illustrating the present disclosure, exemplary constructions of the disclosure are shown in the drawings. However, the present disclosure is not limited to specific methods and instrumentalities disclosed herein. Moreover, those skilled in the art will understand that the drawings are not to scale. Wherever possible, like elements have been indicated by identical numbers.

Embodiments of the present disclosure will now be described, by way of example only, with reference to the following diagrams wherein.

Figure 1:
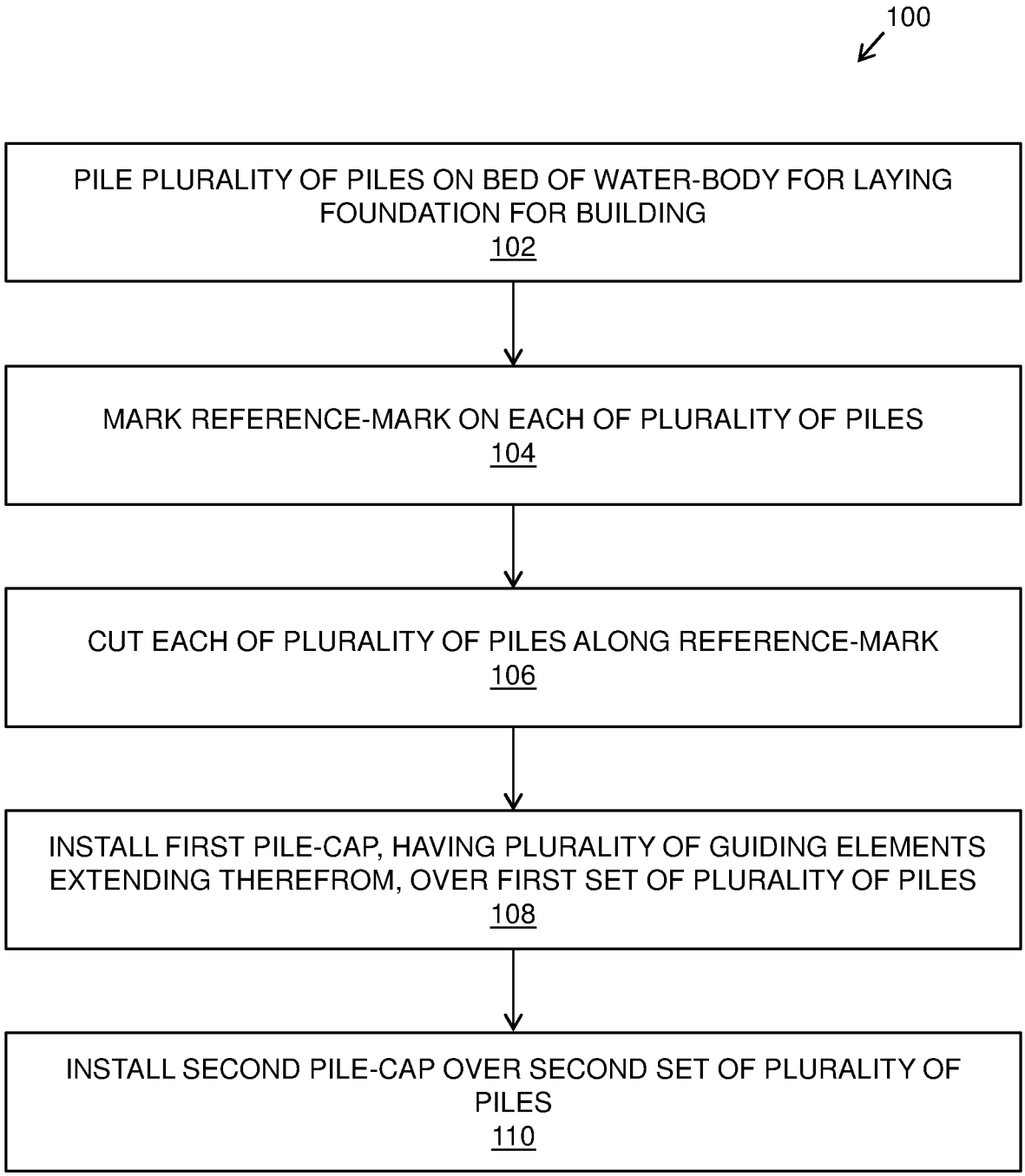
FIG. 1 is a schematic illustration of steps of a method of constructing a building on a water-body, in accordance with an embodiment of the present disclosure.

In the accompanying drawings, an underlined number is employed to represent an item over which the underlined number is positioned or an item to which the underlined number is adjacent. A non-underlined number relates to an item identified by a line linking the non-underlined number to the item. When a number is non-underlined and accompanied by an associated arrow, the non-underlined number is used to identify a general item at which the arrow is pointing.

DETAILED DESCRIPTION OF EMBODIMENTS

The following detailed description illustrates embodiments of the present disclosure and ways in which they can be implemented. Although some modes of carrying out the present disclosure have been disclosed, those skilled in the art would recognize that other embodiments for carrying out or practising the present disclosure are also possible.

In one aspect, an embodiment of the present disclosure provides a method for constructing a building on a water-body, the method comprising:

piling a plurality of piles on a bed of the water-body for laying a foundation for the building;

marking a reference-mark on each of the plurality of piles, wherein the reference-mark is at a predefined-distance from a surface of the water-body;

cutting each of the plurality of piles along the reference-mark;

installing a first pile-cap, having a plurality of guiding elements extending therefrom, over a first set of piles of the plurality of piles, wherein the installation of the first pile-cap comprises aligning the plurality of guiding elements to be received by the first set of piles, adjusting an inclination of the first pile-cap with respect to the first set of piles to allow the first pile-cap to be parallel with respect to surface of the water-body, and coupling the first pile-cap rigidly with the first set of piles; and installing a second pile-cap over a second set of piles of the plurality of piles, wherein the installation of the second pile-cap comprises placing the second pile-cap adjacent to and in contact with the first pile-cap, adjusting an inclination of the second pile-cap using the first pile-cap to allow the second pile-cap to be parallel with respect to the surface of the water-body, wherein the inclination of the second pile-cap using the first pile-cap is adjusted using at least one of: at least one weight and a set of winching tools, and coupling the second pile-cap rigidly with the first pile-cap and the second set of piles.

In another aspect, an embodiment of the present disclosure provides a building on a water-body, the building comprising:

a plurality of piles for laying a foundation for the building, wherein each of the plurality of piles is piled on a bed of the water-body, marked using a reference-mark at a predefined-distance from a surface of the water-body, and cut along the reference-mark;

a first pile-cap, having a plurality of guiding elements extending therefrom, installed over a first set of piles of the plurality of piles, wherein the first pile-cap is installed by aligning the plurality of guiding elements to be received by the first set of piles, adjusting an inclination of the first pile-cap with respect to the first set of piles to allow the first pile-cap to be parallel with respect to the surface of the water-body, and coupling the first pile-cap rigidly with the first set of piles; and a second pile-cap installed over a second set of piles of the plurality of piles, wherein the second pile-cap is installed by placing the second pile-cap adjacent to and in contact with the first pile-cap, adjusting an inclination of the second pile-cap using the first pile-cap to allow the second pile-cap to be parallel with respect to the surface of the water-body, wherein the inclination of the second pile-cap using the first pile-cap is adjusted using at least one of: at least one weight and a set of winching tools, and coupling the second pile-cap rigidly with the first pile-cap and the second set of piles.

The present disclosure provides the aforementioned method for constructing the building on the water-body. The method comprises laying the foundation for the building. Specifically, the method comprises laying the foundation comprising the plurality of piles and the pile-caps. Employment of such a foundation ensures attainment of a planar-surface with respect to a surface of the water-body for the construction of buildings. Notably, the construction of buildings is accomplished over the foundation comprising the plurality of piles and the pile-caps. Furthermore, the attainment of the planar-surface enables an even load distribution of the building over the foundation for the building. The even load distribution allows the building to achieve structural strength and longevity. Subsequently, such a foundation for the building may be employed for construction of buildings comprising multiple floors.

A method for constructing the building on the water-body, wherein the method comprises piling the plurality of piles on the bed of the water-body for laying the foundation for the building. Throughout the present disclosure, the term "building" used herein refers to a temporary or permanent structure of construction comprising a base. Notably, the building may be intended for purposes such as shelter, security, storage, commercial activity, recreation, and the like. Therefore, the building may have a specific shape, size and features, based upon its intended purpose. Moreover, the building could be a single storey building (namely, a single-level building or a single-floor building) or a multi-storey building (namely, a multi-level building or a multi-floor building). Examples of the building include, but are not limited to, a house (for example, such as a bungalow, a villa, an apartment, and the like), a housing complex (for example, a multi-storey structure having multiple apartments), an animal shelter, a fort, a tower, a hotel, a place of worship (for example, such as a temple, a church, and the like), a place of recreation (for example, such as a gymnasium, a community hall, a clubhouse, and the like), a hospital, a commercial establishment (for example, such as a shop, a shopping mall, an office premises, and the like) and an industrial establishment (for example, such as a factory, a warehouse, and the like).

In an embodiment, the building comprises a plurality of supporting-components comprising plinth, walls, columns, beams. The term "supporting-elements" used herein relates to various parts or portions of the building that primarily functions or acts as base structures. The plurality of supporting-elements provide strength and define robustness of the building. It will be appreciated that the plinth of the building would relate to a base-structure that is immediately formed or constructed on the plurality of pile-caps arranged in a horizontal planar structure to support additional elements, such as the walls, thereon. The walls are vertical planar structures extending from the plinth to define and enclose various hollow-spaces within the building. The columns are vertical elongate structures extending from the plinth to laterally supports the walls. The beams are also horizontal elongate structures extending between the columns to supports the columns and the walls. The plurality of supporting-components described herein should not be considered as limiting, and the building may include other supporting-components, such as lintels, sills and the like. The plurality of supporting-components (such as the plinth, the walls, the columns and the beams) described herein may be pre-cast concrete structures made of materials, which include, but are not limited to concrete, metal, plastic, wood and the like.

The building further comprises a plurality of supported-elements comprising: floors, windows, doors and roof. The plurality of supported-elements is movably arranged on the plurality of supporting-components. The term "supported-elements" used herein relates to various parts or portions of the building that primarily functions or acts as integrating structures. However, it will be appreciated that the plurality of supported-elements also, to some extent, provide strength and define robustness of the building. The plurality of supported-elements comprises floors, windows, doors and roof. The floors and the roofs are horizontal planar structures extending between the beams to define and enclose the various hollow-spaces within the building. The windows and the doors are passages configured on the walls. The plurality of supported-elements described herein should not be considered as limiting, and the building may include other supporting-components, such as roof, slabs and the like. The plurality of supported-elements (such as the floors, the windows, the doors and the roof) described herein may be pre-cast concrete structures or pre-fabricated structure made of materials, which include, but are not limited to concrete, metal, plastic, wood and the like. In an example, the building comprises a set of stairs, an elevator, an escalator, a heating-ventilation-air-conditioning (HVAC) unit, a sewer system, an electricity transmission unit, a water-pumping system, an illumination system, a sound attenuator system, a vibration stabilization system, and so forth. Optionally, at least some of the plurality of supporting components and the supported-elements include pipes or conduits arranged there-within or thereon for enabling at least water, air and electrical communication between the supporting components and the supported-elements.

The plurality of supported-elements is typically movably arranged on the plurality of supporting-components to provide integrity to the building. The term "movably arranged" used herein refers to a certain degree of movement of the plurality of supported-elements with respect to the plurality of supporting-components. For example, the plurality of supported-elements may be arranged to change its position (linearly, i.e. horizontally or vertically) in a forward or a backward direction, in an upward or a downward direction, in a leftward or a rightward direction with respect to the plurality of supported-elements. Additionally, the plurality of supported-elements may be arranged to have a rotary (or tilting) movement with respect to the plurality of supported-elements. For example, the degree of movement of the plurality of supported-elements with respect to the plurality of supporting-components may range from couple of centimetres to a meter (i.e. the linear movement), and from one degree to thirty degrees (i.e. the rotary movement).

Throughout the present disclosure, the term "water body" used herein refers to at least one of a pond, a lake, a river, a sea or an ocean. Specifically, the water-body has sufficient quantity of water that allows the building to be suitably constructed on the water-body using a foundation for the building that employs a plurality of piles and the pile-caps thereupon. Furthermore, the water-body may be constituted by a still or moving water. It will be appreciated that the water-body has a bed (referred to as "bed of the water-body" hereafter) and a surface (referred to as "surface of the water-body" hereafter). The bed of the water-body is the deepest layer of the water body that receives the least sun-light. Optionally, the bed of the water-body is composed of soil, silt, reefs, and so forth. The surface of the water-body is the shallowest or the top-most layer of the water-body that receives most of the sun-light. Optionally, the surface of the water-body is visible as the water, namely, tides, ripples, and so forth.

The term "piling" refers to mounting of the plurality of piles on the bed of the water-body, wherein the mounting may be vertical with respect to the bed of the water-body or inclined with respect to the bed of the water-body. The term "plurality of piles" refers to long elongated columnar structures employed as a part of the foundation for the building. Optionally, the plurality of piles have a depth more than three times a breadth. It will be appreciated that a shape, size, form and material of the plurality of piles is chosen according to various factors. Such factors include, but do not limit to, type and load from the building, geology of the area (namely, topography and accessibility of the construction site, types of surrounding structures, salinity and pH of water in the water-body, current of water in the water-body, properties of the soil layer, capability of the soil layer in supporting the piles and the load thereupon, depth of the soil layer and so forth), variations in length of piles required depending upon the depth of the soil layer, availability of resources (namely, fabrication material, logistics, equipment for driving (by means of mounting) the plurality of piles in the bed of the water-body, and so forth), durability of the fabrication material, installation method and budget of the construction.

In an embodiment, each of the plurality of piles is any one of: a hollow structure, a solid structure or a solid structure comprising a cavity to accommodate one of the plurality of guiding elements therein. Typically, the plurality of piles has a three-dimensional (3D) geometrical shape, for example, such as a cylindrical shape, a cuboidal shape, a hexagonal prism shape, or any other elongated polygonal shape, of varying sizes depending upon the afore-mentioned factors. The hollow structure may be a three-dimensional (3D) structure, such as a hollow cylinder, a hollow cuboid, a hollow hexagonal prism, or any other hollow elongated polygon; primarily containing air therein. Furthermore, the plurality of piles may be single hollow structure or a combination of multiple hollow structures.

Furthermore, the plurality of piles may be designed to be a solid structure comprising a hollow (namely a cavity) at the top-surface to accommodate one of the plurality of guiding elements, extending from a corresponding pile-cap, therein. Specifically, the first set of piles of the plurality of piles comprise cavities corresponding to the guiding elements to enable alignment and placement of the latter on the former. Optionally, the second set of piles, and similarly a third set of piles, a fourth set of piles and so forth, of the plurality of piles may or may not comprise a cavity at the top-surface.

In an embodiment, the plurality of piles, having hollow structure or the solid structure comprising the cavity, comprises an outer diameter in a range of 0.5 to 1.5 metres and an inner diameter in a range of 0.2 to 1.2 metres. For example, the outer diameter of the plurality of piles may be from 0.5, 0.6, 0.7, 0.8, 0.9, 1.0, 1.1, 1.2 or 1.3 metres up to 0.7, 0.8, 0.9, 1.0, 1.1, 1.2, 1.3, 1.4 or 1.5 metres and the inner diameter of the plurality of piles may be from 0.2, 0.3, 0.4, 0.5, 0.6, 0.7, 0.8, 0.9 or 1.0 metres up to 0.4, 0.5, 0.6, 0.7, 0.8, 0.9, 1.0, 1.1 or 1.2 metres. While the plurality of piles have an outer diameter in a range of 0.5 to 1.5 metres, the plurality of pipes are solid structures from which a hollow space, implemented by means of a cavity, is carved out rendering an inner diameter of the cavity in a range of 0.2 to 1.2 metres.

In an embodiment, each of the plurality of piles has a length in a range of 10 to 80 metres. For example, the length of each of the plurality of piles may be from 10, 15, 20, 25, 30, 40, 50 or 60 metres up to 30, 35, 40, 45, 50, 60, 70 or 80 metres. It will be appreciated that each of the plurality of piles have length more than the depth of the water-body. For example, each of the plurality of piles has length that is at least 2 metres above the surface of the water-body.

In an embodiment, each of the plurality of piles is fabricated from at least one of steel, an alloy of steel, iron, an alloy of iron, pre-stressed concrete spun and a combination thereof. In addition, each of the plurality of piles is fabricated from at least one of steel, an alloy of steel, iron, an alloy of iron, pre-stressed concrete spun and a combination thereof. Moreover, the texture of the at least one material used for fabricating each of the plurality of piles may be substantially rough, smooth, or any combination thereof, for example, some portions of the plurality of piles may be rough, such that useful for providing a goof grip over the plurality of piles; some portions of the plurality of piles may be smooth, such that for applying chemical solution on the exterior of plurality of piles in order to combat the various environmental and chemical reactions in and outside of the water-body; and some portions of the plurality of piles may be a combination of rough and smooth, such that for making the plurality of piles more resistant to physical impacts (for example, such as a pressure from the surrounding water of the water-body, high tides, high speed winds, cyclones, and the like). For example, by "smooth" is meant texture of an exterior layer having an undulation of less than 1 mm to 4 cm, and preferably, 1.5 mm to 3 cm. Moreover, by "rough" is meant texture of an exterior layer having an undulation of more than 1 mm to 4 cm, and preferably, 1.5 mm to 3 cm. In addition, a finish of the plurality of piles could be uncoated, glossy, matte, and the like.

In an embodiment, an inclination angle of the plurality of piles with respect to the bed of the water-body is in a range of 60 degrees to 120 degrees. The inclination angle of the plurality of piles with respect to the bed of the water-body (or, the surface of the water-body) may be for example, from 60, 70, 80, 90 or 100 degrees up to 80, 90, 100, 110 or 120 degrees.

The term "foundation for the building" refers to a structure that provides support to the building by transferring a load of the building to rocks or layers of soil of the bed of the water-body. Laying the foundation for the building requires piling of the plurality of piles on the bed of the water-body, wherein the plurality of piles are piled at a uniform distance or a non-uniform distance on the bed of the water-body depending on factors such as the load of the building. Piling is implemented such that a portion of the plurality of piles remains above the surface of the water-body. It will be appreciated that the building will be constructed above a substantial height from the surface of the water-body such that water from the water-body does not enter the building during high-tides, floods and so forth. It will be further appreciated that the plurality of piles are manufactured at a different location and transported to a location where the construction of the building is required.

In an embodiment, the piling of the plurality of piles can be achieved using methods such as using a drop-hammer method employing a diesel mechanism, a hydraulic mechanism and so forth. The drop-hammer method requires a hammer with a substantial weight compared to a pile of the plurality of piles, raised at a height and released to strike a top of the pile. Optionally, the equipment employed for the piling is installed in a vessel floating over the water-body. The hammer is released to strike the plurality of piles multiple times until the plurality of piles are sufficiently piled on the bed of the water-body.

The method further comprises marking the reference-mark on each of the plurality of piles, wherein the reference-mark is at the predefined-distance from the surface of the water-body. It will be appreciated that the bed of the water-body is uneven, therefore, the plurality of piles piled at the bed of the water-body will be piled at uneven heights. For a purpose of achieving even height above the surface of water-body for each of the plurality of piles and subsequently to achieve an even planar-surface for the construction of the building, the plurality of piles are marked using a reference-mark at the predefined-distance from the surface of the water-body to assist cutting of the plurality of piles. In an embodiment, the reference-mark is marked using a laser-beamer. The laser-beamer is temporarily affixed on the shore of the water-body such that the laser-beamer attains a stationary position with respect to the plurality of piles. Furthermore, the laser-beamer is temporarily affixed such that a beam of the laser-beamer is targeted on each of the plurality of piles at the predefined-distance from the surface of the water-body.

In an embodiment, the reference-mark is marked at a distance in a range of 3 to 10 metres above the surface of the water-body. For example, the distance for marking the reference-mark may be from 3, 4, 5, 6, 7 or 8 metres up to 6, 7, 8, 9 or 10 metres above the surface of the water-body.

The method further comprises cutting each of the plurality of piles along the reference-mark. The plurality of piles are cut along the reference-mark marked on the plurality of piles. In an example, two piles are of 35 metres each. First pile is piled 10 metres within the bed of the water-body, whereas second pile is piled 15 metres within the bed of the water-body. Therefore, the first pile will be 25 metres above the bed of the water-body, whereas the second pile will be 20 metres above the bed of the water-body. Moreover, a reference-mark is marked 4 metres above the surface of water-body on both the first pile and the second pile. Therefore, the first pile and the second pile are cut along the reference-mark, thereby enabling the first pile and the second pile to achieve even heights above the surface of water-body.

In an embodiment, cutting each of the plurality of piles along the reference-mark allows the top-surface of each of the plurality of piles to attain a planar-surface. The reference-mark on the plurality of piles is marked such that the reference-mark is horizontal with respect to the surface of the water-body. Therefore, the cutting of the plurality of piles along the reference-mark allow the plurality of piles to attain the planar-surface that is horizontal with respect to the surface of the water-body. It will be appreciated that the planar-surface of the plurality of piles are required in order to provide an even surface to the building.

The method further comprises installing the first pile-cap, having the plurality of guiding elements extending therefrom, over the first set of piles of the plurality of piles, wherein the installation of the first pile-cap comprises aligning the plurality of guiding elements to be received by the first set of piles. The term "pile-cap" refers to a solid structure that distributes the load of the building on the plurality of piles, wherein the pile-cap is placed upon the top-surface of the plurality of piles. It will be appreciated that the first set of piles comprise at least three piles. Moreover, the guiding elements are structures that are fixed at a bottom-surface of the first pile-cap. The guiding elements are fixed considering the positions of the first set of piles piled on the bed of the water-body such that the guiding elements are received by the top-surface of the first set of piles when the first pile-cap is placed upon the first set of piles.

In an embodiment, the first pile-cap comprises at least three guiding elements. Notably, a structure with at least three projections extending downwards, in a manner that the three projections are substantially splayed out, attains a stable equilibrium with respect to the floor, namely the first set of piles of the plurality of piles. For example, by "substantially splayed out" is meant a wide and flat placement of about 60° to 120° angle between each of the 3 projections and the inner base of the first pile-cap, and preferably, 30° to 170° angle between each of the 3 projections and the inner base of the first pile-cap. Specifically, the at least three projections, not on a line, define a plane and form a triangle with respect to each other. More specifically, the at least three projections enable contact of all the three projections with the first set of piles of the plurality of piles, despite their lengths. Furthermore specifically, the at least three projections are aligned with the centers of the corresponding cavities of the first set of piles of the plurality of piles. It will be appreciated that the diameter (or the lateral width) of the guiding elements is less than the diameter (or the lateral width) of the cavities of the first set of piles of the plurality of piles. Beneficially, smaller diameter (or the lateral width) of the guiding elements enable their movement within the cavities of the first set of piles of the plurality of piles in order to get the first pile-cap in the desired position, preferably a horizontal planar position with respect to the surface of the water-body.

Typically, the guiding elements have a three-dimensional (3D) geometrical shape, for example, such as a conical shape, a cylindrical shape, a cuboidal shape, a hexagonal shape, a prism shape, or any other polygonal shape. It will be appreciated, that the guiding elements may be of varying sizes depending on the size of the corresponding, for example, first set of piles of the plurality of piles. The guiding elements from the first pile cap extends into the cavities or hollow of the first set of piles of the plurality of piles. The extension is such that a first guiding element of the at least three guiding elements extends into a corresponding first cavity or hollow of the first set of piles, a second guiding element of the at least three guiding elements extends into a corresponding second cavity or hollow of the first set of piles and a third guiding element of the at least three guiding elements extends into a corresponding third cavity or hollow of the first set of piles to form a triangle. Beneficially, the triangular arrangement of the guiding elements from the first pile cap over the first set of piles of the plurality of piles provide a stable and planar alignment of the former with respect to the latter. Additionally, alignment of the first pile-cap, as horizontally as possible avoids problems when constructing the building on top of the foundation for the building.

The method further comprises adjusting the inclination of the first pile-cap with respect to the first set of piles to allow the first pile-cap to be parallel with respect to the surface of the water-body. The first set of piles may not be at a uniform height with respect to the surface of the water-body due to uneven cutting of the first set of piles. The uneven cutting due to factors such as environmental factors may cause the top-surface of the plurality of piles to be uneven. Moreover, the first pile-cap develops inclination when placed over the first set of piles with uneven top-surfaces. The inclination of the first pile-cap is required to be adjusted in order to achieve a parallel planar-surface with respect to the surface of the water-body for the construction of the building thereon.

In an embodiment, the inclination of the first pile-cap with respect to the first set of piles is adjusted using at least one weight. The at least one weight is kept on the inclined first pile-cap such that the first pile-cap attains parallel position with respect to the surface of the water-body. In one example, the at least one weight may be a stone kept on the inclined first pile-cap such that the first pile-cap attains the parallel position with respect to the surface of the water-body. It will be appreciated that the first pile-cap will be in contact will at least one of the piles of the first set of piles after the adjustment of the inclination of the first pile-cap.

The method further comprises coupling the first pile-cap rigidly with the first set of piles. The first pile-cap that is parallel with respect to the surface of the water-body is rigidly coupled to the first set of piles such that the first pile-cap attains a stationary position with respect to the first set of piles. The at least one weight is subsequently removed from the first pile-cap once the first pile-cap and the first set of piles are coupled. In an embodiment, the coupling is achieved by using one of: normal welding, buttering welding or welding using a pair of sleeves. The coupling of the first pile-cap and the first set of piles is ensured by welding. Furthermore, the type of welding employed depends on the distance between the first pile-cap and at least one pile of the first set of piles.

In an embodiment, the normal welding is employed between the first pile-cap and the at least one pile, of the first set of piles, in contact with the first pile-cap. As mentioned above, the first set of piles may not be at a uniform height with respect to the surface of the water-body. The at least one pile of the first set of piles with a height more than other piles of the first set of piles will be in contact with the first pile-cap. Moreover, the top-surface of the at least one pile in contact with the first pile-cap may or may not be even. The distance between the first pile-cap and the at least one pile is negligible or substantially minimum, therefore, the normal welding is employed to couple the first pile-cap and the at least one pile in contact therewith. It will be appreciated that the normal welding is sufficient to couple the first pile-cap and the at least one pile that are in contact with each other.

In an embodiment, the buttering welding is employed between the first pile-cap and at least one pile, of the first set of piles, if the distance therebetween is less than a predetermined value. The term "buttering welding" refers to a type of welding, wherein an appropriate welding metal is deposited on one or more welding parts to provide a metallurgical compatible welding metal for a subsequent completion of the weld between the one or more welding parts. Buttering welding is employed when the normal welding is not sufficient to couple the first pile-cap with the at least one pile i.e. when the distance between the first pile-cap and at least one pile is less than the predetermined value but the first pile-cap and at least one pile are not in contact. In an embodiment, the predetermined value may be defined as a value that is 1 to 1.5 times the thickness of the wall of the hollow plurality of piles. Therefore, when the distance between the first pile-cap and at least one pile is less than the predetermined value (for example, 20 millimetres), the first pile-cap and at least one pile are coupled using the buttering welding.

In an embodiment, the welding using the pair of sleeves is employed between the first pile-cap and the at least one pile, of the first set of piles, if the distance therebetween is more than the predetermined value. Welding using a pair of sleeves is employed when the normal welding and the buttering welding are not sufficient to couple the first pile-cap with the at least one pile i.e. when the distance between the first pile-cap and at least one pile is more than the predetermined value. In an embodiment, the pair of sleeves are a pair of semi-circular metallic structures employed to provide a weld that is structurally strong to hold the welding parts together. It will be appreciated that the diameter of the sleeves will be more than the outer diameter of the at least one pile. Optionally, the pair of sleeves comprises a plurality of slots therein to provide more surface-area for the coupling of the first pile-cap with the at least one pile. The welding using the pair of sleeves is employed such as the pair of sleeves enclose the at least one pile. Moreover, the pair of sleeves further conceals the distance between the first pile-cap and the at least one pile thereby enabling the coupling of the first pile-cap and the at least one pile. The plurality of slots in the pair of sleeves enhances the strength of the coupling between the first pile-cap and the at least one pile. The coupling of the first pile-cap with the first set of piles ensures the first pile-cap is rigidly fixed over the first set of piles.

The method further comprises installing the second pile-cap over the second set of piles of the plurality of piles, wherein the installation of the second pile-cap comprises placing the second pile-cap adjacent to and in contact with the first pile-cap. The second pile-cap is placed over the second set of piles after the installation of the first pile-cap. The second pile-cap is placed adjacent to the first pile-cap rigidly placed such that an edge of the second pile-cap and an edge of the first pile-cap are in contact. In an embodiment, the distance between the edge of the second pile-cap and the edge of the first pile-cap may be in a range of 1 to 10 centimetres. For example, the distance between the edge of the second pile-cap and the edge of the first pile-cap may be from 1, 2, 3, 4, 5, 6, 7 or 8 centimetres up to 3, 4, 5, 6, 7, 8, 9 or 10 centimetres. Optionally, the preferred placement of the second pile-cap and the first pile-cap is when they are placed substantially in contact with each other. For example, by "substantially" is meant identical to within ±2 centimetres distance, more optionally to within ±0.1 centimetres (or 1 millimetre) distance. In such a case, the distance between the edge of the second pile-cap and the edge of the first pile-cap may be in a range of 1 millimetre to 1 centimetres. It will be appreciated that the second pile-cap may or may not have dimensions same as that of the first pile-cap.

The method further comprises adjusting the inclination of the second pile-cap using the first pile-cap to allow the second pile-cap to be parallel with respect to the surface of the water-body. The second set of piles may not be at a uniform height with respect to the surface of the water-body due to uneven cutting of the second set of piles. The uneven cutting may cause the top-surface of the second set of piles to be uneven. Moreover, the second pile-cap develops inclination when placed over the second set of piles with uneven top-surfaces. The inclination of the second pile-cap is required to be adjusted in order to achieve a parallel planar-surface with respect to the surface of the water-body for the construction of the building thereon.

The inclination of the second pile-cap using the first pile-cap is adjusted using at least one of: at least one weight and a set of winching tools. In an embodiment, the at least one weight is kept on the inclined second pile-cap such that the second pile-cap attains parallel position with respect to the surface of the water-body. In an embodiment, the set of winching tools is employed to adjust the inclination of the second pile-cap using the first pile-cap. Optionally, the set of winching tools comprise a pair of winch and a rope holding the pair of winch. Furthermore, the set of winching tools may comprise an electrically driven motor employed therein. The set of winching tools enables the second pile-cap to be in alignment with the first pile-cap that has attained the parallel position with respect to the surface of the water-body. It will be appreciated that the second pile-cap will be in contact will at least one of the piles of the second set of piles after the adjustment of the inclination of the second pile-cap.

The method further comprises coupling the second pile-cap rigidly with the first pile-cap and the second set of piles. The edge of the second pile-cap is coupled to the edge of the first pile-cap, wherein the second pile-cap and the first pile-cap are parallel with respect to the surface of the water-body. Furthermore, the second pile-cap that is parallel with respect to the surface of the water-body is rigidly coupled to the second set of piles. It will be appreciated that the at least one weight or the set of winching tools is subsequently removed from the second pile-cap once the second pile-cap is rigidly coupled with the first pile-cap and the second set of piles.

In an embodiment, the normal welding is employed between the first pile-cap and the second pile-cap in contact with the first pile-cap. The first pile-cap and the second pile-cap are placed in contact with each other, therefore, the normal welding is sufficient to hold the first pile-cap and the second pile-cap together rigidly. In an embodiment, the edge of the first pile-cap and the edge of the second pile-cap are not in contact with each other. In such a case, buttering welding may be employed to couple the first pile-cap and the second pile-cap together. Furthermore, the normal welding is employed between the second pile-cap and at least one pile, of the second set of piles, in contact with the second pile-cap. As mentioned above, the second set of piles may not be at a uniform height with respect to the surface of the water-body. The at least one pile of the second set of piles with a height more than other piles of the second set of piles will be in contact with the second pile-cap. Moreover, the top-surface of the at least one pile of the second set of piles in contact with the second pile-cap may or may not be even. The distance between the second pile-cap and the at least one pile is negligible or substantially minimum, therefore, the normal welding is employed to couple the second pile-cap and the at least one pile in contact therewith. It will be appreciated that the normal welding is sufficient to couple the second pile-cap and the at least one pile that are in contact with each other.

In an embodiment, the buttering welding is employed between the second pile-cap and at least one pile, of the second set of piles, if a distance therebetween is less than the predetermined value. Buttering welding is employed when the normal welding is not sufficient to couple the second pile-cap with the at least one pile i.e. when the distance between the second pile-cap and at least one pile is less than the predetermined value but the second pile-cap and at least one pile are not in contact therewith. Therefore, when the distance between the second pile-cap and at least one pile of the second set of piles is less than the predetermined value (for example, 20 millimetres), the second pile-cap and at least one pile are coupled using the buttering welding.

In an embodiment, the welding using a pair of sleeves is employed between the second pile-cap and the at least one pile of, the plurality of piles, if the distance therebetween is more than the predetermined value. Welding using a pair of sleeves is employed when the normal welding and the buttering welding are not sufficient to couple the second pile-cap with the at least one pile i.e. when the distance between the second pile-cap and at least one pile is more than the predetermined value. Optionally, the pair of sleeves comprises a plurality of slots therein to provide more surface-area for the coupling of the second pile-cap with the at least one pile of the second set of piles. The welding using the pair of sleeves is employed such as the pair of sleeves enclose the at least one pile. Moreover, the pair of sleeves further conceals the distance between the second pile-cap and the at least one pile thereby enabling the coupling of the second pile-cap and the at least one pile. The plurality of slots in the pair of sleeves enhances the strength of the coupling between the second pile-cap and the at least one pile. The coupling of the second pile-cap with the second set of piles ensures the second pile-cap is rigidly fixed over the second set of piles.

In an embodiment, the first pile-cap and the second pile-cap have a length in a range of 40 to 100 metres and a width in a range of 20 to 50 metres. For example, the length of the first pile-cap and the second pile-cap may be from 40, 45, 50, 55, 60, 70 or 80 metres up to 60, 65, 70, 75, 80, 90 or 100 metres, and the width of the first pile-cap and the second pile-cap may be from 20, 25, 30, 35 or 40 metres up to 30, 35, 40, 45 or 50 metres. While the length and the width of the first pile-cap and the second pile-cap may be in a range of 40 to 100 metres and 20 to 50 metres respectively, the final structure, namely the horizontal planar structure, made by adjoining such plurality of first pile-cap and the second pile-cap may be a planar structure with an length and a width of the aforesaid final construction may be any of: 100×50 metres, 200×100 metres, 40×40 metres, 200×200 metres and so forth.

Optionally, a load on the bottom of the pile-cap may be reduced with the help of a plurality of pile extension parts. The plurality of pile extension parts is installed inside of the pile-cap on the top of the plurality of piles. Furthermore, the pile extension parts may be secured together using a plurality of ring plates.

It will be appreciated that the foundation for the building may comprise added set of piles other than the first set of piles and the second set of piles, of the plurality of piles, and subsequently added pile-caps depending upon the requirements of the building to be constructed thereon.

DETAILED DESCRIPTION OF THE DRAWINGS

Referring to FIG. 1, illustrated are steps of a method 100 of constructing a building on a water-body, in accordance with an embodiment of the present disclosure. At step 102, a plurality of piles is piled on a bed of the water-body for laying a foundation for the building. At step 104, a reference-mark is marked on each of the plurality of piles. The reference-mark is at a predefined-distance from a surface of the water-body. At step 106, each of the plurality of piles are cut along the reference-mark. At step 108, a first pile-cap, having a plurality of guiding elements extending therefrom, is installed over a first set of piles of the plurality of piles. The installation of the first pile-cap comprises aligning the plurality of guiding elements to be received by the first set of piles, adjusting an inclination of the first pile-cap with respect to the first set of piles to allow the first pile-cap to be parallel with respect to surface of the water-body, and coupling the first pile-cap rigidly with the first set of piles. At step 110, a second pile-cap is installed over a second set of piles of the plurality of piles. The installation of the second pile-cap comprises placing the second pile-cap adjacent to and in contact with the first pile-cap, adjusting an inclination of the second pile-cap using the first pile-cap to allow the second pile-cap to be parallel with respect to the surface of the water-body, and coupling the second pile-cap rigidly with the first pile-cap and the second set of piles.

The steps 102 to 110 are only illustrative and other alternatives can also be provided where one or more steps are added, or one or more steps are provided in a different sequence without departing from the scope of the claims herein.

Figure 2:
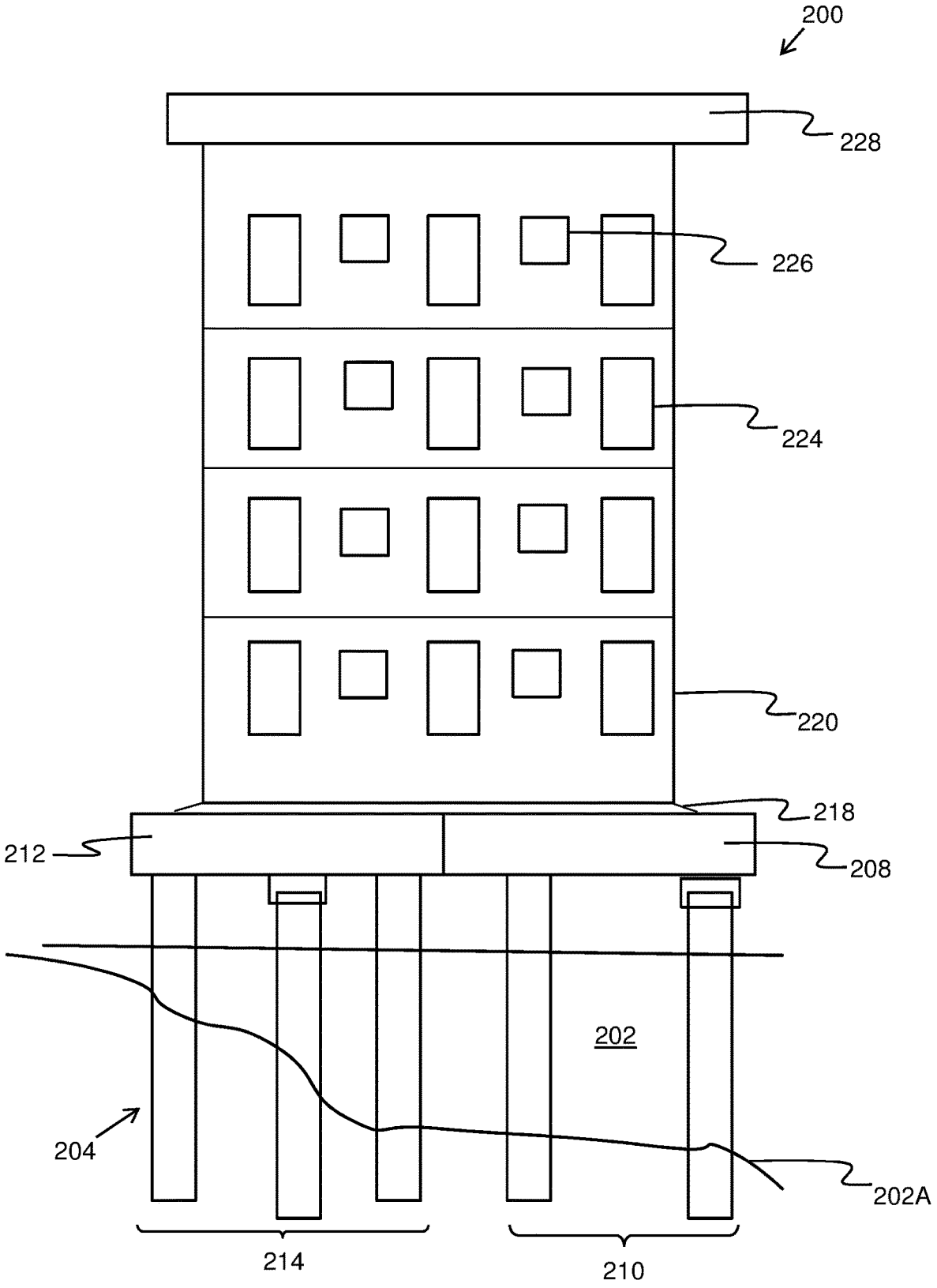
FIG. 2 is a schematic front view of a building on a water-body, in accordance with an embodiment of the present disclosure.

Referring to FIG. 2, illustrated is a schematic front view of a building 200 on a water-body 202, in accordance with an embodiment of the present disclosure. The building 200 comprises a plurality of piles 204 for laying a foundation for the building. Each of the plurality of piles 204 is piled on a bed 202A of the water-body. The building 200 includes a first pile-cap 208 installed over a first set of piles 210 of the plurality of piles 204. The building 200 also includes a second pile-cap 212 installed over a second set of piles 214 of the plurality of piles 204. The building 200 also comprises a plurality of supporting-components, for example supporting-components 218, 220 (such as plinth, walls and columns), mounted on the pile caps 208, 212; and a plurality of supported-elements, for example supported-elements 224, 226, 228 (such as doors, windows and a roof), arranged on the supporting-components 218, 220.

Figure 3:
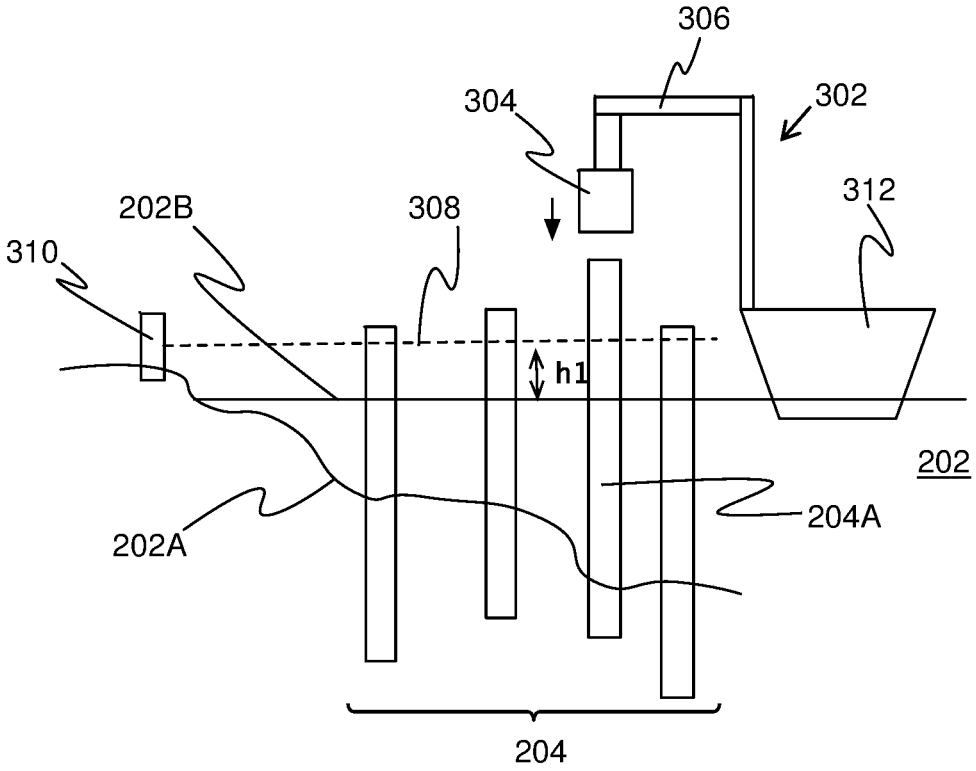
FIG. 3 is schematic side view of a plurality of piles being piled on a bed of the water-body, in accordance with an embodiment of the present disclosure.

Referring to FIG. 3, illustrated are schematic side view of a plurality of piles, such as the plurality of piles 204 being piled on a bed, such as the bed 202A, of the water-body 202, in accordance with an embodiment of the present disclosure. As shown, the plurality of piles 204 piled on the bed 202A of the water-body 202 a piling machine 302. The piling machine 302 has a hammer 304 operable to be raised to a height and released to strike on top of a pile 204A multiple times until the pile 204A is sufficiently piled on the bed 202A. The piling machine 302 also includes an actuating mechanism 306 operable to maneuver (raise and lower) the hammer 304. The piling machine 302 is installed in a vessel, such as a boat 312, floating over the water-body 202. Further, as shown, for the purpose of achieving an even height, such as a predefined-distance h1 above a surface 202B of the water-body 202, each of the plurality of piles 204 is marked using a reference-mark 308. The reference-mark 308 is marked using a laser-beamer 310.

Figure 4:
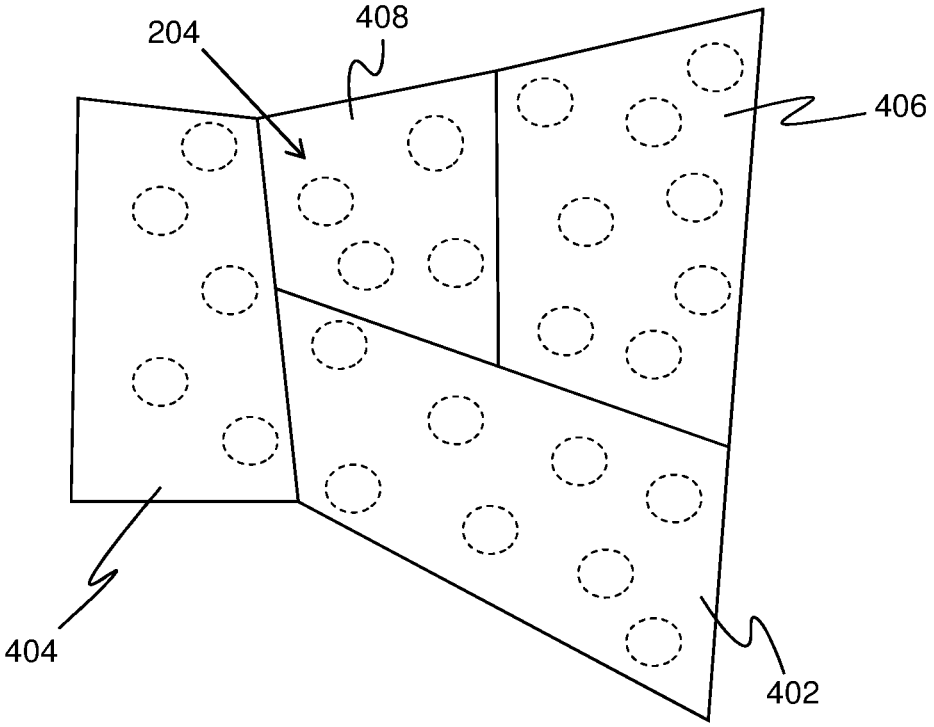
FIG. 4 is a schematic top view a plurality of pile-caps arranged on the plurality of piles, in accordance with an embodiment of the present disclosure.

Referring to FIG. 4, illustrated is a schematic top view a plurality of pile-caps arranged on the plurality of piles, in accordance with an embodiment of the present disclosure. As shown, the plurality of pile-caps, such as a first pile-cap 402, a second pile-cap 404, a third pile-cap 406 and a fourth pile-cap 408, arranged on top of the plurality of piles 204.

Figure 5:
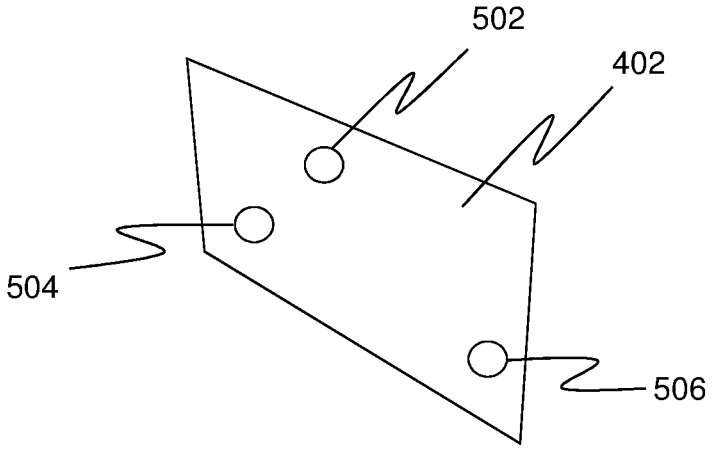
FIG. 5 is a schematic a bottom view of a pile-cap having a plurality of guiding elements, in accordance with an embodiment of the present disclosure.

Referring to FIG. 5, illustrated is a schematic bottom view of a pile-cap, such the first pile-cap 402 of FIG. 4, having a plurality of guiding elements, such as guiding elements 502, 504 and 506, in accordance with an embodiment of the present disclosure.

Figure 6:
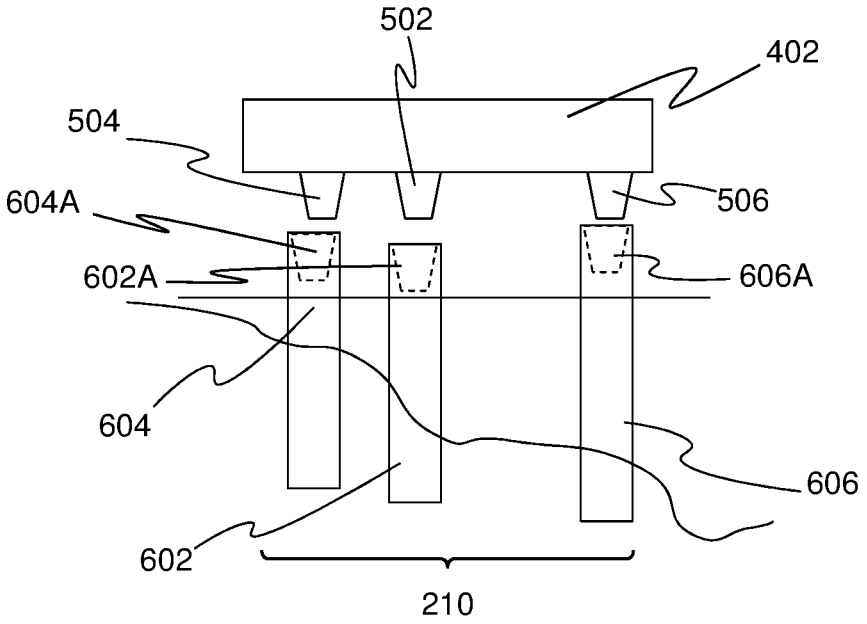
FIGS. 6 and 7 are schematic side views depicting installation of a first pile-cap, having a plurality of guiding elements, over a first set of piles of the plurality of piles, in accordance with an embodiment of the present disclosure.
Figure 7:
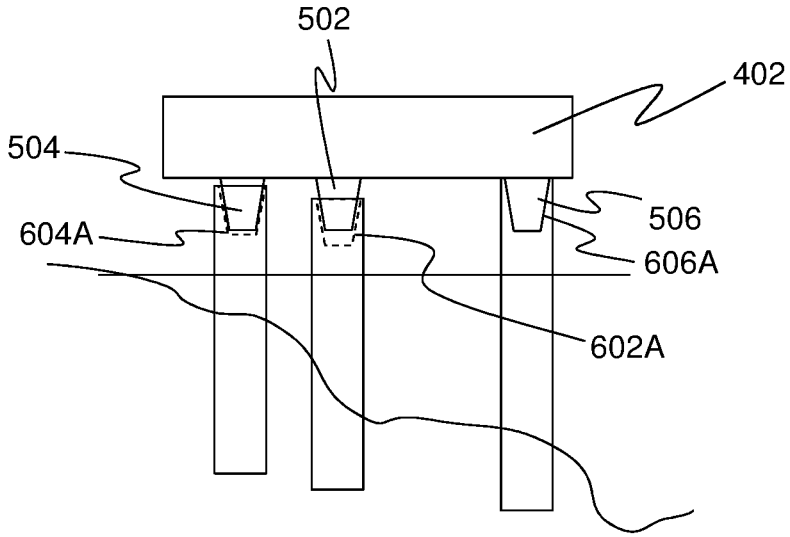

Referring to FIGS. 6 and 7, illustrated are schematic side views depicting installation of a first pile-cap, such as the first pile-cap 402, having a plurality of guiding elements, such as the guiding elements 502, 504 and 506, over a first set of piles, such as first set of piles 210, of the plurality of piles 204 (shown in FIG. 2), in accordance with an embodiment of the present disclosure. As shown, the first set of piles 210 includes piles 602, 604 and 606, each having a cavity, such cavities 602A, 604A and 606A, respectively. The cavities 602A, 604A, 606A are configured to receive the guiding elements 502, 504, 506 therein. In FIG. 7, the guiding elements 502, 504, 506 are shown received in the cavities 602A, 604A and 606A, respectively.

Figure 8:
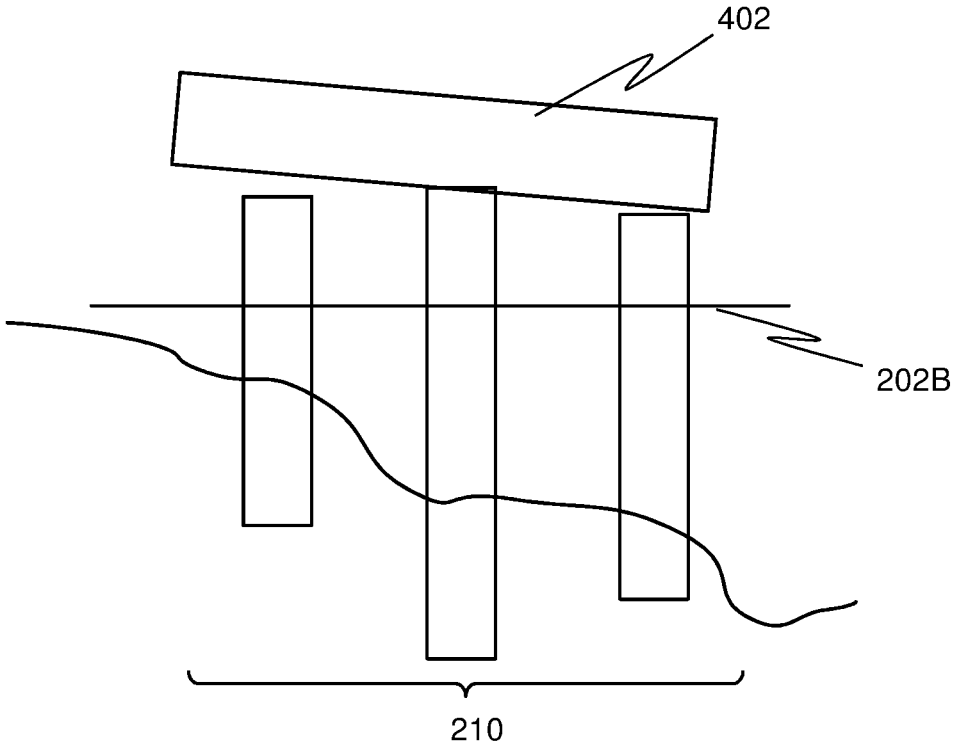
FIG. 8 is a schematic side view depicting inclination adjustment of the first pile-cap with respect to the first set of piles, in accordance with an embodiment of the present disclosure.

Referring to FIG. 8, illustrated is a schematic side view depicting inclination adjustment of the first pile-cap 402 with respect to the first set of piles 210, in accordance with an embodiment of the present disclosure. As shown, when the first pile-cap 402 is lowered, the first pile-cap 402 may attain a tilted position with respect to top planar surfaces of the first set of piles 210. In such instance, the first pile-cap 402 is at an inclined angle with respect to the surface 202B of the water-body.

Figure 9:
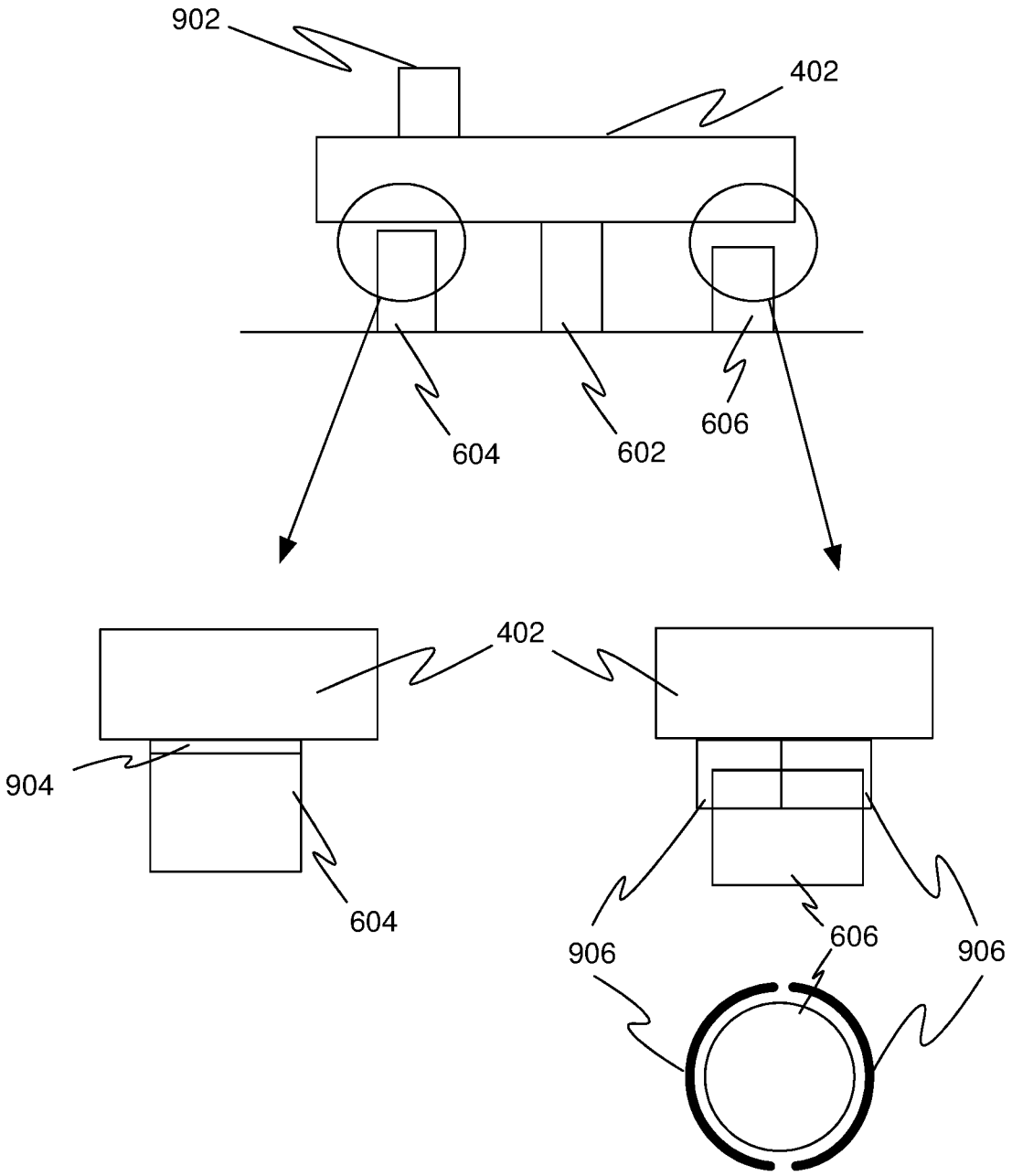
FIG. 9 is a schematic side view depicting coupling of the first pile-cap with the first set of piles, in accordance with an embodiment of the present disclosure.

Referring to FIG. 9, illustrated is schematic side view depicting coupling of the first pile-cap 402 with the first set of piles 210 in accordance with an embodiment of the present disclosure. As shown, a weight 902 is used (placed at an appropriate place) for inclination adjustment of the first pile-cap 402 with respect to the first set of piles, such the piles 602, 604 and 606. As shown, the pile 602 is the tallest amongst the three piles 602, 604 and 606. Therefore, the first pile-cap 402 shall contact and attain a horizontal position on top of the pile 602. Therefore, normal welding is applied to secure the first pile-cap 402 and the pile 602. However, the first pile-cap 402 and the pile 604 are spaced apart by a distance less than a predetermined value, therefore buttering welding 904 is employed therebetween. Moreover, the first pile-cap 402 and the pile 606 are spaced apart by a distance more than a predetermined value, therefore welding using a pair of sleeves 906 is employed therebetween.

Figure 10:
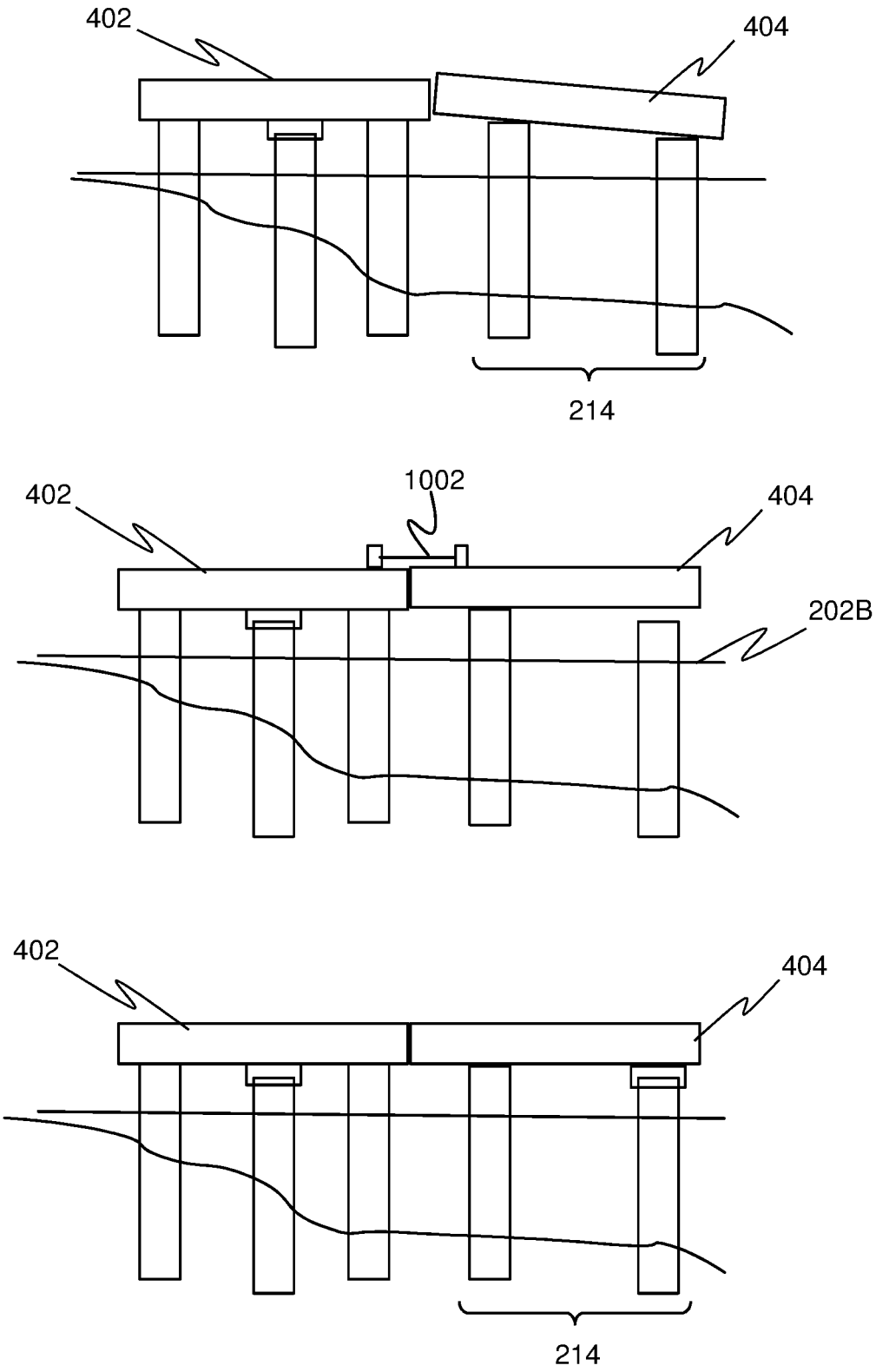
FIG. 10 is a schematic side view depicting installation of a second pile-cap, adjacent to the first pile-cap, over a second set of piles of the plurality of piles, in accordance with an embodiment of the present disclosure.

FIG. 10 is a schematic side view depicting installation of a second pile-cap 404, adjacent to the first pile-cap 402, over a second set of piles 214 of the plurality of piles 204 (shown in FIG. 2), in accordance with an embodiment of the present disclosure. The second pile-cap 404 is lowered adjacent and in contact with the first pile-cap 402. Thereafter, the first pile-cap 402 and the second pile-cap 404 are connected with the help of a winching tools 1002 for adjusting the inclination of the second pile-cap 404 with respect to the first pile-cap 402 (i.e., to make horizontal to the surface 202B of the water body). Thereafter, the first pile-cap 402 and the second pile-cap 404 are connected (i.e. either by normal welded or buttering welding, when marginally spaced apart from each other). Finally, the second set of piles 214 are coupled to the second pile-cap 404 (i.e. either by normal welded when in contact, or buttering welding or welding using pair of sleeves when spaced apart from each other based on the predetermined value).

Modifications to embodiments of the present disclosure described in the foregoing are possible without departing from the scope of the present disclosure as defined by the accompanying claims. Expressions such as "including", "comprising", "incorporating", "have", "is" used to describe and claim the present disclosure are intended to be construed in a non-exclusive manner, namely allowing for items, components or elements not explicitly described also to be present. Reference to the singular is also to be construed to relate to the plural.

The invention claimed is:

1. A method for constructing a building on a water-body, the method comprising:

piling a plurality of piles on a bed of the water-body for laying a foundation for the building;

marking a reference-mark on each of the plurality of piles, wherein the reference-mark is at a predefined-distance from a surface of the water-body;

cutting each of the plurality of piles along the reference-mark;

installing a first pile-cap, having a plurality of guiding elements extending therefrom, over a first set of piles of the plurality of piles, wherein the installation of the first pile-cap comprises aligning the plurality of guiding elements to be received by the first set of piles, adjusting an inclination of the first pile-cap with respect to the first set of piles to allow the first pile-cap to be parallel with respect to surface of the water-body, and coupling the first pile-cap rigidly with the first set of piles;

wherein the method further comprises installing a second pile-cap over a second set of piles of the plurality of piles, wherein the installation of the second pile-cap comprises placing the second pile-cap adjacent to and in contact with the first pile-cap, adjusting an inclination of the second pile-cap using the first pile-cap to allow the second pile-cap to be parallel with respect to the surface of the water-body, wherein the inclination of the second pile-cap using the first pile-cap is adjusted by using a set of winching tools mounted on the first pile-cap and the second pile-cap, and coupling the second pile-cap rigidly with the first pile-cap and the second set of piles.

2. The method according to claim 1, wherein cutting each of the plurality of piles along the reference-mark allows a top-surface of each of the plurality of piles to attain a planar-surface.

3. The method according to claim 1, wherein the reference-mark is marked using a laser-beamer.

4. The method according to claim 1, wherein the inclination of the first pile-cap with respect to the first set of piles is adjusted using at least one weight.

5. The method according to claim 1, wherein the coupling is achieved by using one of: normal welding, buttering welding, welding using a pair of sleeves.

6. The method according to claim 5, wherein the normal welding is employed, between the first pile-cap and at least one pile, of the first set of piles, in contact with the first pile-cap, between the second pile-cap and at least one pile, of the second set of piles, in contact with the second pile-cap, and between the first pile-cap and the second pile-cap in contact with the first pile-cap.

7. The method according to claim 5, wherein the buttering welding is employed between the first pile-cap and at least one pile, of the first set of piles, if a distance therebetween is less than a predetermined value, and between the second pile-cap and at least one pile, of the second set of piles, if a distance therebetween is less than the predetermined value.

8. The method according to claim 7, wherein the welding using a pair of sleeves is employed between the first pile-cap and the at least one pile, of the first set of piles, if the distance therebetween is more than the predetermined value, and between the second pile-cap and the at least one pile, of the second set of piles, if the distance therebetween is more than the predetermined value.

9. The method according to claim 1, wherein the inclination of the second pile-cap using the first pile-cap is adjusted by using a weight as well, and wherein the weight is different from a weight of the second pile-cap.

10. A building on a water-body produced according to the method of claim 1.

11. The building according to claim 10, wherein each of the plurality of piles is any one of: a hollow structure, a solid structure or a solid structure comprising a cavity to accommodate one of the plurality of guiding elements therein.

12. The building according to claim 11, wherein each of the plurality of piles, having hollow structure or the solid structure comprising the cavity, comprises an outer diameter in a range of 0.5 to 1.5 metres and an inner diameter in a range of 0.2 to 1.2 metres.

13. The building according to claim 10, wherein the first pile-cap comprises at least three guiding elements.

14. The building according to claim 10, wherein each of the plurality of piles has a length in a range of 10 to 80 metres.

15. The building according to claim 10, wherein each of the plurality of piles is fabricated from at least one of steel, an alloy of steel, iron, an alloy of iron, pre-stressed concrete spun and a combination thereof.

16. The building according to claim 10, wherein the reference-mark is marked at a distance in a range of 3 to 10 metres above the surface of the water-body.

17. The building according to claim 10, wherein the first pile-cap and the second pile-cap have a length in a range of 40 to 100 metres and a width in a range of 20 to 50 metres.

18. The building according to claim 10, further comprising:

a plurality of supporting-components including plinth, walls, columns and beams, and a plurality of supported-elements including floors, windows, doors and roof.

* * * * *